US008685608B2

(12) United States Patent
Takahashi et al.

(10) Patent No.: US 8,685,608 B2
(45) Date of Patent: Apr. 1, 2014

(54) TWO-COMPONENT DEVELOPER, DEVELOPER CARTRIDGE, PROCESS CARTRIDGE, AND IMAGE FORMING APPARATUS

(75) Inventors: Sakon Takahashi, Kanagawa (JP); Motoko Sakai, Kanagawa (JP); Yutaka Saito, Kanagawa (JP); Katsuyuki Kitajima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 257 days.

(21) Appl. No.: 12/875,531

(22) Filed: Sep. 3, 2010

(65) Prior Publication Data

US 2011/0229812 A1 Sep. 22, 2011

(30) Foreign Application Priority Data

Mar. 16, 2010 (JP) ..... 2010-059951

(51) Int. Cl.
*G03G 9/00* (2006.01)

(52) U.S. Cl.
USPC ..... 430/111.35; 430/108.1; 430/109.4

(58) Field of Classification Search
USPC ..... 430/108.1, 109.4, 111.35
See application file for complete search history.

(56) References Cited

U.S. PATENT DOCUMENTS

| | | | | |
|---|---|---|---|---|
| 5,145,761 | A * | 9/1992 | Kubo et al. | 430/111.1 |
| 5,340,677 | A * | 8/1994 | Baba et al. | 430/111.35 |
| 5,631,116 | A * | 5/1997 | Uchida et al. | 430/111.1 |
| 5,712,073 | A | 1/1998 | Katada et al. | |
| 6,447,972 | B1 * | 9/2002 | Nakajima et al. | 430/111.35 |
| 2003/0148203 | A1 * | 8/2003 | Suzuki et al. | 430/110.3 |
| 2005/0202332 | A1 * | 9/2005 | Ninomiya et al. | 430/110.3 |
| 2005/0282078 | A1 * | 12/2005 | Kataoka et al. | 430/111.32 |
| 2006/0269323 | A1 * | 11/2006 | Kabata et al. | 399/159 |
| 2009/0035683 | A1 | 2/2009 | Imafuku et al. | |
| 2009/0061333 | A1 * | 3/2009 | Matsumoto et al. | 430/48 |
| 2009/0109448 | A1 * | 4/2009 | Kiyono et al. | 358/1.1 |
| 2009/0208862 | A1 * | 8/2009 | Anno et al. | 430/108.7 |

FOREIGN PATENT DOCUMENTS

| | | |
|---|---|---|
| JP | B2-2-21591 | 5/1990 |
| JP | A-10-003179 | 1/1998 |
| JP | A-H10-186863 | 7/1998 |
| JP | A-2002-287410 | 10/2002 |
| JP | A-2003-177570 | 6/2003 |
| JP | A-2007-17842 | 1/2007 |
| JP | A-2008-256840 | 10/2008 |

(Continued)

OTHER PUBLICATIONS

Owens et al., "Estimation of the Surface Free Energy of Polymers," Journal of Applied Polymer Science, Aug. 1969, vol. 13, No. 8, pp. 1741-1747. (with Abstract).

Sep. 25, 2013 Submission of Information filed in Japanese Application No. 2010-059951 with English-language translation.

(Continued)

*Primary Examiner* — Hoa V Le
(74) *Attorney, Agent, or Firm* — Oliff PLC

(57) ABSTRACT

A two-component developer includes: a toner; a carrier having a surface energy of from about 23 dyne/cm to about 37 dyne/cm; and an external additive having a shape factor SF1 of from about 130 to about 150 and a number-average particle diameter of from about 80 nm to about 1 μm; and an existence ratio A of the external additive on a surface of the toner and an existence ratio B of the external additive on a surface of the carrier satisfying the relationship of the following Expression 1: $0.04 \leq B/A \leq 0.4$.

14 Claims, 2 Drawing Sheets

(56) References Cited

FOREIGN PATENT DOCUMENTS

| | | |
|---|---|---|
| JP | A-2009-36980 | 2/2009 |
| JP | A-2009-204695 | 9/2009 |
| JP | A-2009-229621 | 10/2009 |

OTHER PUBLICATIONS

Jan. 7, 2014 Notice of Reasons for Rejection issued in Japanese Application No. 2010-059951 with English-language translation.

* cited by examiner

TWO-COMPONENT DEVELOPER, DEVELOPER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2010-059951 filed on Mar. 16, 2010.

BACKGROUND

1. Technical Field

The present invention relates to a two-component developer, a developer cartridge, a process cartridge, and an image forming apparatus.

2. Related Art

Two-component developers including a toner and a carrier are known, in which external additives are added to the toner.

SUMMARY

According to an aspect of the invention, there is provided a two-component developer including:

a toner;

a carrier having a surface energy of from about 23 dyne/cm to about 37 dyne/cm; and an external additive having a shape factor SF1 of from about 130 to about 150 and a number-average particle diameter of from about 80 nm to about 1 μm; and an existence ratio A of the external additive on a surface of the toner and an existence ratio B of the external additive on a surface of the carrier satisfying the relationship of the following Expression 1.

$$0.04 \leq B/A \leq 0.4 \qquad \text{Expression 1:}$$

BRIEF DESCRIPTION OF THE DRAWINGS

Exemplary embodiments of the present invention will be described in detail based on the following figures, wherein.

DETAILED DESCRIPTION

Figure 1:
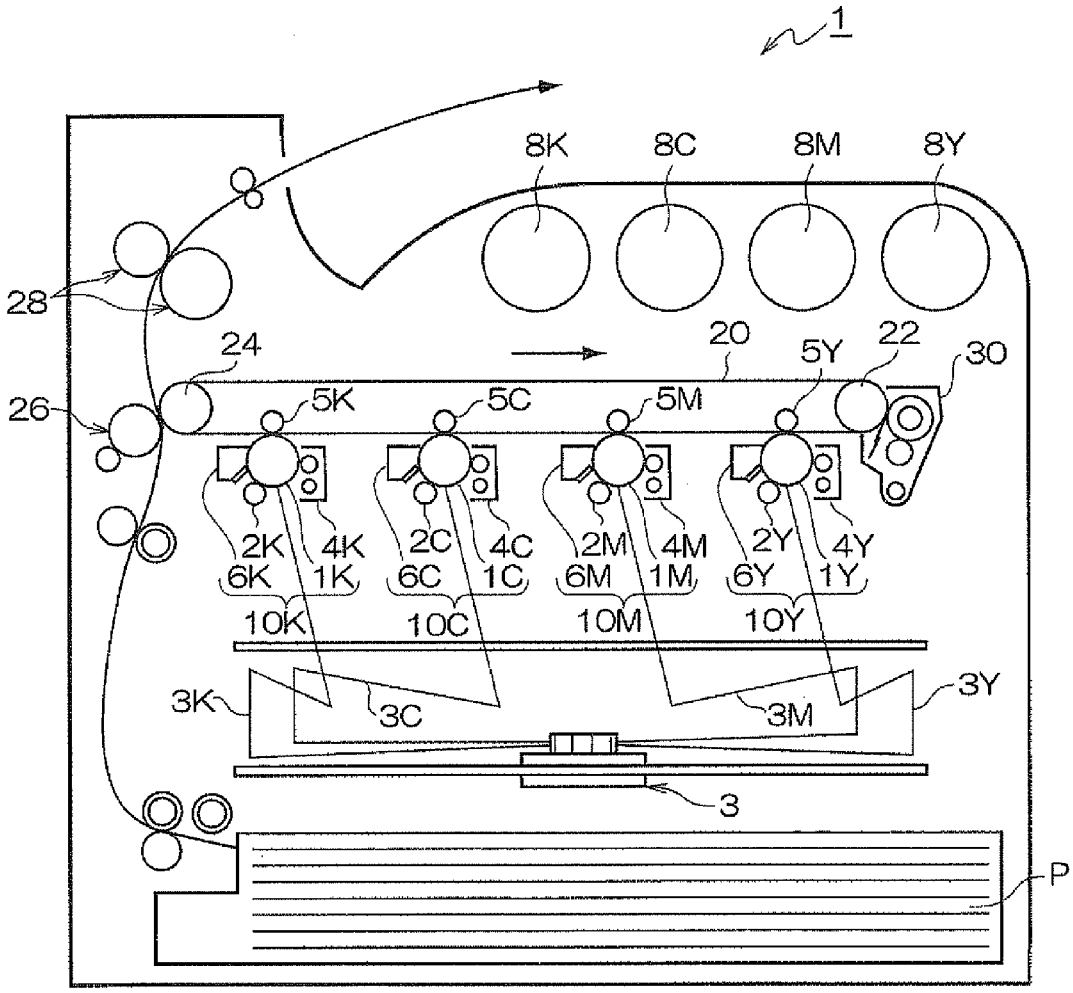
FIG. 1 is a diagram schematically illustrating the configuration of an image forming apparatus according to an exemplary embodiment of the invention.

According to the invention, there is provided a two-component developer which suppresses a variation in density of images formed using the two-component developer even when the amount of toner consumed per recording medium varies, as compared with the case in which a toner that does not include a carrier of which surface energy is in the range according to the invention and external additives of which shape factor and number-average particle diameter are in the ranges according to the invention and the relationship between the existence ratio of the external additives on the toner surface and the existence ratio of the external additives on the carrier surface do not satisfy the relationship of Expression 1 according to the invention.

Hereinafter, exemplary embodiments of the invention will be described in detail.

Two-Component Developer

A two-component developer according to an exemplary embodiment of the invention includes: a toner; a carrier having a surface energy in the range of from 23 dyne/cm to 37 dyne/cm (or from about 23 dyne/cm to about 37 dyne/cm); and an external additive having a shape factor SF1 of from 130 to 150 (or from about 130 to about 150) and a number-average particle diameter of from 80 nm to 1 μm (or from about 80 nm to about 1 μm), wherein an existence ratio A of the external additive on the surface of the toner and an existence ratio B of the external additive on the surface of the carrier satisfy the relationship of the following Expression 1.

$$0.04 \leq B/A \leq 0.4 \qquad \text{Expression 1:}$$

Specifically, a two-component developer according to an exemplary embodiment of the invention includes:

a toner including toner particles;

a carrier including carrier particles and having a surface energy in the range of from 23 dyne/cm to 37 dyne/cm (or from about 23 dyne/cm to about 37 dyne/cm); and an external additive having a shape factor SF1 of from 130 to 150 (or from about 130 to about 150) and a number-average particle diameter of from 80 nm to 1 μm (or from about 80 nm to about 1 μm), wherein an existence ratio A of the external additive at the surfaces of the toner particles and an existence ratio B of the external additive at the surfaces of the carrier particles satisfy the following expression (1).

$$0.04 \leq B/A \leq 0.4 \qquad \text{Expression 1:}$$

Here, developers in which various external additives are added to a toner are known as examples of the two-component developer including a toner and a carrier. In a case in which an image forming apparatus employing the two-component developer including a toner and an external additive added thereto is used, the amount of charge on the toner may vary and the density of an image to be formed may vary, when the amount of consumed toner (so-called throughput) varies. It has been thought that this phenomenon is caused because a part of an external additive added to toner particles is released and migrates to the surfaces of carrier particles, and the external additive is then fixed at the surfaces of the carrier particles. Accordingly, measures have been devised to prevent the fixation of the external additive at the surfaces of the carrier particles.

In contrast, as the result of extensive study, the inventors of the present invention have found that an external additive having a number-average particle diameter of from 80 nm to 1 μm is not fixed onto the carrier surface and keeps attached to the carrier surface with a weak force permitting detachment. The inventors have also found that the variation in charge of the toner caused by the variation in the amount of the consumed toner is derived from the migration of the external additive between the toner and the carrier.

In this regard, the inventors noted that the external additive migrates between the toner and the carrier in the two-component developer, and found that in an image forming apparatus using a two-component developer which includes a toner, a carrier having a surface energy in the range of from 23 dyne/cm to 37 dyne/cm, and an external additive having a shape factor in the range of from 130 to 150 and a number-average particle diameter in the range of from 80 nm to 1 μm, in which an existence ratio A of the external additive on the toner surface and an existence ratio B of the external additive on the carrier surface satisfy the relationship of Expression 1, the variation in charge of the toner included in the two-component developer is suppressed and the variation in density of an image to be formed is suppressed, even when the amount of toner consumed per recording medium varies.

Although the reason is not clear, it is thought that the reason why is because, by satisfying the relationship, the migration of the external additive from the toner to the carrier is suppressed and the external additive can be easily returned to the toner even when the external additive migrates to the carrier.

Details of respective materials of the developer will be described.

Toner

First, the toner will be described.

The toner (toner particles) includes at least a binder resin and may further include a colorant, a release agent, and other internal additives as needed. In other words, the toner includes toner particles, and the toner particles include at least a binder resin and may further include a colorant, a releasing agent, and other internal additives as needed.

The binder resin is not particularly limited, but examples thereof include: homopolymers formed of monomers such as styrenes (such as styrene, parachlorostyrene, or α-methylstyrene), esters having a vinyl group (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), vinyl nitriles (such as acrylonitrile or methacrylonitrile), vinyl ethers (such as vinyl methyl ether or vinyl isobutyl ether), vinyl ketones (such as vinyl methyl ketone, vinyl ethyl ketone, or vinyl isopropenyl ketone), or polyolefins (such as ethylene, propylene, or butadiene); copolymers obtained by using a combination of two or more of these monomers; and mixtures thereof. Other examples of the binder resin include non-vinyl condensation resins such as an epoxy resin, a polyester resin, a polyurethane resin, a polyimide resin, a cellulose resin, or a polyether resin, a mixture of any one of these resins and any one of the vinyl resins, and graft polymers obtained by polymerizing the vinyl monomers under the presence of the condensation resins.

The styrene resin, the (meth)acryl resin, and the styrene-(meth)acryl copolymer resin may be obtained, for example, by known methods using styrene monomers or (meth)acrylic acid monomers singly or using a combination of styrene monomers and (meth)acrylic acid monomers. The term "(meth)acryl" means that it includes both "acryl" and "methacryl". Similarly, the term "(meth)acrylic" means that it includes both "acrylic" and "methacrylic".

The polyester resin may be obtained by synthesizing appropriate components selected from dicarboxylic acid components and diol components using a known method such as an ester exchange method or a condensation-polymerization method.

When a styrene resin, a (meth)acryl resin, or a copolymer resin thereof is used as the binder resin, it is preferable that the binder resin has a weight-average molecular weight (Mw) in the range of from 20,000 to 100,000 (or from about 20,000 to about 100,000) and a number-average molecular weight (Mn) in the range of from 2,000 to 30,000 (or from about 2,000 to about 30,000). On the other hand, when a polyester resin is used as the binder resin, it is preferable that the binder resin has a weight-average molecular weight (Mw) in the range of from 5,000 to 40,000 (or from about 5,000 to about 40,000) and a number-average molecular weight (Mn) in the range of from 2,000 to 10,000 (or from about 2,000 to about 10,000).

The weight-average molecular weight is measured by a gel permeation chromatography (GPC). The measurement of the molecular weight by the GPC is performed with a chloroform solvent using GPC HLC-8120 (trade name, manufactured by TOSOH Corporation) as a measurement apparatus and using columns TSK-GEL GMHHR-M+TS GEL GMHHR-M (7.8 mm I.D. 30 cm) (trade name, manufactured by TOSOH Corporation). The weight-average molecular weight is calculated using a molecular weight calibration curve formed from the measurement result in terms of a monodispersed polystyrene standard sample. The weight-average molecular weights described hereinafter are those obtained by this method.

The number-average molecular weight is a value obtained by measuring a molecular weight using the gel permeation chromatography (GPC) and converting the measured value using a standard curve in terms of standard polyethylene glycol (PEG). The number-average molecular weights described hereinafter are those obtained by this method.

The glass-transition temperature of the binder resin is preferably in the range of from 40° C. to 80° C. (or from about 40° C. to about 80° C.). When the binder resin has a glass-transition temperature within this range, the heat blocking resistance and the lowest fixing temperature are maintained.

Any one of the known colorants is used as the colorant without particular limitation. Examples of the colorant include carbon black such as farness black, channel black, acetylene black, or thermal black, inorganic pigments such as colcothar, Prussian blue, or titanium oxide, azo pigments such as Fast yellow, disazo yellow, pyrazolone red, chelate red, brilliant carmine, or para Brown, phthalocyanine pigments such as copper phthalocyanine or metal-free phthalocyanine, and condensed polycyclic pigments such as flavanthrone yellow, dibromoanthrone orange, perylene red, quinacridone red, or dioxazine A surface-processed colorant may be used as the colorant as needed. The colorant may be used in combination with a dispersing agent. Any one of the colorants may be used singly, or a combination of plural species of the colorants may be used.

The content of the colorant in the toner is preferably in the range of from 1 part by weight to 30 parts by weight with respect to 100 parts by weight of the binder resin.

Examples of the release agent include, but not limited to: hydrocarbon wax; natural wax such as carnauba wax, rice wax, or candy lira wax; synthesized or mineral and petroleum wax such as montan wax; and ester wax such as fatty acid ester or montanic acid ester.

The melting point of the release agent is preferably 50° C. or higher (or about 50° C. or higher), and more preferably 60° C. or higher (or about 60° C. or higher), in view of preservability. The melting point of the release agent is preferably 110° C. or lower (or about 110° C. or lower), and more preferably 100° C. or lower (or about 100° C. or lower), in view of offset resistance.

The content of the release agent in the toner is preferably in the range of from 1% by weight to 15% by weight (or from about 1% by weight to about 15% by weight), more preferably in the range of from 2% by weight to 12% by weight (or from about 2% by weight to about 12% by weight), and still more preferably in the range of from 3% by weight to 10% by weight (or from about 3% by weight to about 10% by weight).

Examples of other internal additives include a magnetic substance, a charge control agent, and an inorganic powder.

The volume-average particle diameter of the toner is preferably in the range of from 2 μm to 10 μm (or from about 2 μm to about 10 μm), and more preferably in the range of from 4 μm to 8 μm (or from about 4 μm to about 8 μm).

The volume-average particle diameter of the toner is measured using COULTER MULTISIZER II (trade name, manufactured by Beckman Coulter Inc.) with an aperture diameter of 50 μm. The measurement is carried out after the toner is dispersed in an electrolyte aqueous solution (ISOTON solution (registered trademark) manufactured by Beckman Coulter Inc.) using ultrasonic waves for 30 seconds or more.

Specifically, in the measurement, 0.5 to 50 mg of a sample to be measured is added to 2 ml of a 5% aqueous solution containing a surfactant, preferably alkylbenzene sodium sulfonate, as a dispersing agent, and the resultant is added to 100 to 150 ml of the electrolyte. The electrolyte containing the sample suspended therein is subjected to a dispersion treatment using an ultrasonic disperser for about 1 minute, and then the size distribution of particles is measured. The number of particles to be measured is 50,000.

The measured size distribution of the particles is accumulated to draw a cumulative distribution from the smallest diameter for the volume in divided size ranges (channels), and the particle diameter corresponding to 50% in the cumulative distribution is defined as the volume-average particle diameter.

Regarding the shape factor SF1 of the toner, the toner preferably has a spherical shape in view of transferability. The shape factor SF1 of the toner is in the range of from 120 to 140 (or from about 120 to about 140), and preferably in the range of from 120 to 135 (or from about 120 to about 135).

The shape factor SF1 of the toner is obtained in such a manner that: an image of toner particles dispersed on a slide glass is taken using a video camera through an optical microscope and is then input to an image analyzer LUZEX; the maximum lengths and the projection areas of 50 or more toner particles are measured; and the shape factor SF1 is calculated as an average value of $(\text{maximum length of toner})^2/(\text{projection area of toner})\times(\pi/4)\times 100$.

Examples of a toner producing method include a kneading and pulverizing method and a wet granulation method. The wet granulation method is preferable. Examples of the wet granulation method include a fusion and suspension method, an emulsion aggregation method, and a dissolution and suspension method which are known.

Carrier

Next, the carrier will be described below.

The carrier preferably has a surface energy in the range of from 23 dyne/cm to 37 dyne/cm, more preferably in the range of from 23 dyne/cm to 35 dyne/cm, and still more preferably in the range of from 25 dyne/cm to 33 dyne/cm.

The surface energy of the carrier may be measured as follows.

That is, the surface energy of the carrier may be calculated in such a manner that: first, a substrate having a surface layer formed from the same material as that of the surface layer of a carrier is prepared; and contact angles between the surface layer and various solvents, of which surface tension components are known, are measured on the surface layer of the substrate.

Specifically, under the conditions of 20° C. and 50% RH, the respective contact angles between methylene iodide and water and the substrate are measured, and the surface energy is calculated from the measurements. More specifically, the surface energy is calculated in accordance with the measurement method described in Estimation of the Surface Free Energy of Polymers (JOURNAL OF APPLIED POLYMER SCIENCE VOL. 13, p. 1741-1747 (1969)).

The surface energy of the carrier is adjusted by adjusting constituent materials of the surface of the carrier. The details of the adjustment method will be described later.

The carrier is not particularly limited, as long as the surface energy thereof satisfies the above-mentioned range, and known carriers may be used. Examples of the carrier include magnetic powders, magnetic powder-dispersed resin particles in which magnetic powder is dispersed in a resin, and a resin-coated carrier having a magnetic powder or magnetic powder-dispersed resin particle as a core and a resin coating layer on the surface of the core.

Examples of the magnetic powders (core) include powders of a magnetic metal (such as iron oxide, nickel, or cobalt), a magnetic oxide (such as ferrite or magnetite), or the like.

The volume-average particle diameter of the magnetic powders (core) is preferably in the range of from 10 μm to 500 μm, and more preferably in the range of from 30 μm to 100 μm.

Examples of the coating resin or the resin used for dispersing the magnetic powders include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin having an organosiloxane bond or a modified resin thereof, a fluorine-containing resin, polyester, polycarbonate, a phenol resin, an epoxy resin, and a silicone resin.

Among these, in view of easiness in adjusting the surface energy of the carrier to the above-mentioned range, the coating resin or resin used for dispersing the magnetic powders is preferably a resin having a resin containing a fluorine group or a resin having a strong negative charge such as a resin containing a silicone component. By adjusting the composition and the mixture ratio of the materials, the surface energy of the carrier is adjusted to the above-mentioned range. It is thought that when the surface energy of the carrier adjusted to fall within the range, the electrostatic force against the external additive is weakened, and the relationship of Expression 1 is satisfied.

From this point of view, preferable examples of the coating resin or the resin used for dispersing the magnetic powders, which may be included in the carrier, include a perfluorooctylethyl methacrylate/methyl methacrylate copolymer, a perfluorohexylethyl methacrylate/methyl methacrylate copolymer, a perfluorobutylethyl methacrylate/methyl methacrylate copolymer, a silicone resin, polycarbonate, isobornyl methacrylate, cyclohexyl methacrylate, adamantine methacrylate, and alkoxysilyl methacrylate.

An example of the method of coating the surface of a core with a resin includes a method of coating the core with a coating layer forming solution in which the coating resin and, if necessary, respective additives are dissolved in an appropriate solvent. The solvent is not particularly limited, but may be selected in consideration of the coating resin to be used and the application aptitude.

Specific examples of the method of coating a core with a resin include an immersion method of immersing the core of a carrier in a coating layer forming solution, a spray method of spraying a coating layer forming solution on the core surface of a carrier, a fluidized bed method in which a coating layer forming solution is sprayed to a core of a carrier in the state where the core is floated by flowing air, and a kneader/coater method in which the core of a carrier and a coating layer forming solution are mixed in a kneader/coater, and the solvent is removed.

The volume resistivity of the carrier is preferably in the range of from $1\times10^5$ Ωcm to $1\times10^{15}$ Ωcm (or from about $1\times10^5$ Ωcm to about $1\times10^{15}$ Ωcm), more preferably in the range of from $1\times10^8$ Ωcm to $1\times10^{14}$ Ωcm (or from about $1\times10^8$ Ωcm to about $1\times10^{14}$ Ωcm), and still more preferably in the range of from $1\times10^8$ Ωcm to $1\times10^{13}$ Ωcm (or from about $1\times10^8$ Ωcm to about $1\times10^{13}$ Ωcm).

When the resistivity of the carrier is within this range, the generation of white-out or the variation in image density is suppressed.

Here, the volume resistivity (Ωcm) of the carrier is measured as follows. The measurement was carried out under the conditions of a temperature of 20° C. and a humidity of 50% RH.

A carrier to be measured is evenly placed on the surface of a circular jig, on which an electrode plate of 20 $cm^2$ is disposed, so as to have a thickness of from 1 mm to 3 mm, thereby forming a layer of the carrier. Another electrode plate of 20 $cm^2$ is placed thereon so as to interpose the carrier layer between two electrode plates. To remove gaps among the carrier particles, a load of 4 kg is applied onto the electrode plate placed on the carrier layer, and then the thickness (cm) of the carrier layer is measured. Both of the electrodes that are respectively present on and under the carrier layer are connected to an electrometer and a high-voltage source. Then, a high voltage is applied to both electrodes so as to form an electric field of 6,000 V/cm, and the value of current (A) flowing at this time is measured by reading, followed by calculation of the volume resistivity (Ωcm). The expression used for calculating the volume resistivity (Ωcm) of the carrier is represented by the following Expression 4.

$$R=E\times 20/(I-I_0)/L \qquad \text{Expression 4:}$$

In Expression 4, R represents the volume resistivity (Ωcm) of a carrier, E represents the applied voltage (V), I represents the value of current (A), $I_0$ represents the current value (A) when the applied voltage is 0 V, and L represents the thickness (cm) of a carrier layer. Coefficient "20" represents the area ($cm^2$) of the electrode plate.

Here, the mixture ratio (weight ratio) of the toner and the carrier (i.e., toner:carrier) is preferably in the range of from 1:100 to 30:100, and more preferably in the range of from 3:100 to 20:100.

External Additive

Next, the external additive will be described below.

The two-component developer according to an exemplary embodiment further includes, as an external additive, an external additive (hereinafter, which may be referred to as "large-diameter external additive") having a shape factor SF1 of from 130 to 150 and a number-average particle diameter of from 80 nm to 1 μm.

The shape factor SF1 of the large-diameter external additive is in the range of from 130 to 150, preferably in the range of from 130 to 145, and more preferably in the range of from 135 to 145.

When the shape factor SF1 of the large-diameter external additive is within the ranges, the migration of the large-diameter external additive to the carrier is suppressed.

The shape factor SF1 of the external additive is obtained in such a manner that: an image of external additive particles dispersed on a slide glass is taken using a video camera through an optical microscope and is then input to an image analyzer LUZEX; the maximum lengths and the projection areas of 50 or more external additive particles are measured: and the shape factor SF1 is calculated as an average value of (maximum length of external additive)$^2$/(projection area of external additive)×(π/4)×100.

The shape factor SF1 of the external additive is adjusted, for example, by a production process or the like. For example, when fumed silica is used, the shape factor can be adjusted by changing an oxygen concentration, a combustion temperature, or the like, and when colloidal silica is used, the shape factor can be adjusted by changing a solution concentration.

The number-average particle diameter of the large-diameter external additive is in the range of from 80 nm to 1 μm, preferably in the range of from 80 nm to 500 nm, and more preferably in the range of from 80 nm to 300 nm.

When the number-average particle diameter of the large-diameter external additive particles is within the ranges, the attachment of the large-diameter external additive to the carrier is suppressed, and the deterioration in transfer efficiency is suppressed. In addition, when the two-component developer including such a large-diameter external additive is used in an image forming apparatus, the leakage of the developer out of a developing device is also suppressed.

The number-average particle diameter of the large-diameter external additive may be calculated as follows. The external additive is observed using a scanning electron microscope (for example, S-4100 manufactured by Hitachi Co., Ltd.) and images thereof are taken. Then, the images are input to an image analyzer (for example, LUZEX III manufactured by NIRECO Corporation), equivalent circle diameters (or projected area diameter) of 300 primary particles are measured, and the average thereof is calculated, which is defined as the number-average particle diameter of the primary particles. The magnification ratio of the electron microscope is adjusted so that 10 to 50 external additive particles exist in a field of sight, and the equivalent circle diameters of the primary particles are measured by the observation through plural fields of sight.

Examples of the large-diameter external additive include metal oxide particles (such as silica particles, titania particles, alumina particles, or cerium oxide particles), resin particles (such as polystyrene particles, acryl resin particles, polyester particles, urethane particles, or cross-linkable resin particles), and composite particles (such as strontium titanate particles, calcium titanate particles, or silicon carbide particles). Only one of them may be used singly, or a combination of two or more species thereof may be used.

Among these particles, in view of strength, small influence on the color gamut, safety, and cost, silica particles are preferably used as the large-diameter external additive. In view of the size distribution control, silica particles obtained by a sol-gel method or a wet method is particularly preferably used.

These particles may be subjected to a surface treatment (e.g., hydrophobizing treatment). The surface treatment may be performed, for example, using a coupling agent (such as a silane coupling agent or a titanate coupling agent), silicone oil, a fatty acid metal salt; or a charge control agent. Among these, in view of the improvement in adhesion to the toner, it is preferable that the large-diameter external additive is provided with a hydrophobized surface layer by a surface treatment using a surface treatment agent containing a nitrogen (N) atom.

Examples of the surface treatment agent containing a nitrogen atom include a silane coupling agent having a functional group containing nitrogen atom and silicone oil. More specific examples thereof include amino silane coupling agents, such as HMDS (hexamethyl disilazane), 3-aminopropyl trimethoxy silane, 3-aminopropyl triethoxy silane, N-2(aminoethyl)-3-aminopropylmethyl dimethoxy silane, N-2(aminoethyl)-3-aminopropyl trimethoxy silane, N-2(aminoethyl)-3-aminopropyl triethoxy silane, or amino-modified silicone oil.

The content of the large-diameter external additive in a developer is preferably in the range of from 0.5 parts by weight to 10 parts by weight, and more preferably in the range of from 1 part by weight to 5 parts by weight, with respect to 100 parts by weight of the toner.

Other External Additives

The two-component developer according to an exemplary embodiment may further include, as an additional external additive, an external additive having a number-average particle diameter smaller than that of the large-diameter external additive.

An example of the additional external additive may be an external additive (hereinafter, which may be referred to as "small-diameter external additive") having a number-average particle diameter of 10 nm or more and less than 80 nm.

Examples of the small-diameter external additive include silica particles, alumina particles, titanium oxide particles, barium titanate particles, magnesium titanate particles, calcium titanate particles, strontium titanate particles, zinc oxide particles, silica sand particles, clay particles, mica particles, wollastonite particles, diatomite particles, cerium chloride particles, colcothar particles, chromium oxide particles, cerium oxide particles, antimony trioxide particles, magnesium oxide particles, zirconium oxide particles, silicon carbide particles, silicon nitride particles, calcium carbonate particles, magnesium carbonate particles, and calcium phosphate particles. These particles may be surface-treated.

The content of the additional external additive (which means the total content when plural species of additional external additives are used) in a developer is preferably in the range of from 0.3 parts by weight to 3.0 parts by weight with respect to 100 parts by weight of the toner.

Method of Producing Two-Component Developer

The two-component developer according to an exemplary embodiment is obtained by mixing the toner, the carrier, and the large-diameter external additive, and, if necessary, other materials.

The two-component developer is obtained by: introducing the toner and the large-diameter external additive into a known mixer such as a V blender, a Henschel mixer, or a Lodige mixer, and stirring and mixing them at a temperature around the glass transition temperature of the resin contained in the toner, to prepare a toner with the large-diameter external additive externally added thereto; introducing the carrier therein; and stirring and mixing the them.

As described above, in the two-component developer according to an exemplary embodiment, the existence ratio A of the external additive on the toner surface and the existence ratio B of the external additive on the carrier surface satisfy the relationship represented by the following Expression 1.

$$0.04 \leq B/A \leq 0.4 \qquad \text{Expression 1:}$$

The relationship between the existence ratio A of the external additive on the toner surface and the existence ratio B of the external additive on the carrier surface should necessarily satisfies Expression 1 of $0.04 \leq B/A \leq 0.4$, as described above, but preferably satisfies the relationship of $0.04 \leq B/A \leq 0.35$, and more preferably satisfies the relationship of $0.05 \leq B/A \leq 0.3$.

When the existence ratio A of the external additive on the toner surface and the existence ratio B of the external additive on the carrier surface satisfy the relationship represented by Expression 1, it is thought that the variation in charge of the toner included in the two-component developer is suppressed even when the amount of consumed toner varies.

Examples of the adjustment for causing the existence ratio A of the external additive on the toner surface and the existence ratio B of the external additive on the carrier surface to satisfy the conditional relationship of Expression 1 include the adjustment of the shape factor SF1 of the large-diameter external additive, the preparation of the surface preparation agent of the large-diameter external additive, the adjustment of the surface energy of the carrier, the number-average particle diameter of the large-diameter external additive, and the amount of large-diameter external additive. The conditional relationship of Expression 1 is satisfied by making an adjustment in combination thereof.

Specifically, as the shape of the large-diameter external additive becomes closer to a nonspheric shape (i.e., becomes apart from a spheric shape), the contact area between the large-diameter external additive and the toner becomes larger and the large-diameter external additive can be more easily kept on the toner surface. By selecting a surface treatment agent used for the large-diameter external additive, the electrostatic force between the large-diameter external additive and the toner is adjusted, whereby the migration of the large-diameter external additive to the carrier is suppressed.

Accordingly, as described above, by setting the shape factor SF1 of the large-diameter external additive having a number-average particle diameter of from 80 nm to 1 μm to the range of from 130 to 150, and adjusting the surface energy of the carrier within the range of from 25 dyne/cm to 37 dyne/cm, and, if necessary, employing a suitable other treatment, the relationship between the existence ratio A of the external additive on the toner surface and the existence ratio B of the external additive on the carrier surface is adjusted to satisfy Expression 1.

The shape factor SF1 of the large-diameter external additive, the surface treatment agent for the large-diameter external additive, and the adjustment of the surface energy of the carrier are described above, and the descriptions thereof are thus omitted here.

The existence ratio A of the external additive on the toner surface and the existence ratio B of the external additive on the carrier surface are values measured just after the two-component developer is produced (specifically, within 24 hours after the stirring and mixing).

The existence ratio A of the external additive on the toner surface and the existence ratio B of the external additive on the carrier surface can be calculated as follows.

First, the two-component developer is evenly applied onto a conductive tape and is subjected to a vapor deposition process using an ion sputter (E 1030, trade name, manufactured by Hitachi Instruments Service Co., Ltd.) under a depressurized condition of 15 Pa or less for 80 seconds using platinum palladium as a target. The toner and the carrier included in the developer at 30 arbitrary positions are photographed, respectively, using HITACHI SCANNING ELECTRON MICROSCOPE S 4100 (trade name, manufactured by Hitachi Co., Ltd.) at a magnification ratio of 20,000. Then, 15 photographs in which the large-diameter external additive particles are dispersed as evenly as possible are selected from the 30 images taken of the carrier particles and the toner particles, respectively.

Existence Ratio A of Large-Diameter External Additive on Toner Surface

In each of the 15 photographs of the toner particles, regions in which the large-diameter external additive particles are relatively evenly dispersed are selected. On the basis of the scales shown in the photographs, at least a part of a region in which the large-diameter external additive particles are relatively evenly dispersed is surrounded with a square with a side of 2 μm, and the number of large-diameter external additive particles included in the square is counted. By dividing the number of large-diameter additive particles by 4 $\mu m^2$, the number of large-diameter external additive particles existing per 1 $\mu m^2$ of the toner particles is calculated. The results of 15 photographs are averaged to obtain an "existence ratio A of the external additive on the toner surface".

Existence Ratio B of Large-Diameter External Additive on Carrier Surface

In each of the 15 photographs of the carrier particles, regions in which the large-diameter external additive particles are relatively evenly dispersed are selected. On the basis of the scales shown in the photographs, at least a part of a region in which the large-diameter external additive particles are relatively evenly dispersed is surrounded with a square with a side of 2 μm, and the number of large-diameter external additive particles included in the square is counted. By dividing the number of large-diameter additive particles by 4 $\mu m^2$, the number of large-diameter external additive particles existing per 1 $\mu m^2$ of the carrier particles is calculated. The results of 15 photographs are averaged to obtain an "existence ratio B of the external additive on the carrier surface".

Image Forming Apparatus

An image forming apparatus according to an exemplary embodiment will be described.

The image forming apparatus according to an exemplary embodiment includes: an image holder; a charging device that charges the image holder; a latent image forming device that forms an electrostatic latent image on the surface of the charged image holder; a developing device that contains a two-component developer and develops the electrostatic latent image formed on the image holder into a toner image by the use of the two-component developer; a transfer device that transfers the toner image formed on the image holder to a transfer medium; and a fixing device that fixes the toner image transferred onto the transfer medium. The two-component developer according to the exemplary embodiments of the invention is used as the developer.

In the image forming apparatus according to an exemplary embodiment, for example, a portion including the developing device may have a cartridge structure (i.e., process cartridge) which can be detachably mounted on the image forming apparatus. A process cartridge containing a developer for electrostatic charge image development according to an exemplary embodiment of the invention and having a developing device may be preferably used as the process cartridge.

Hereinafter, an example of the image forming apparatus according to an exemplary embodiment will be described, but the invention is not limited to this example. The principal parts shown in the drawings will be described and the other parts will not be described.

FIG. 1 is a diagram schematically illustrating the configuration of a 4-drum tandem color image forming apparatus 1. The image forming apparatus shown in FIG. 1 includes first to fourth image forming units 10Y, 10M, 10C, and 10K (image forming measures) of an electrophotographic type that output color images of yellow (Y), magenta (M), cyan (C), and black (K), respectively, based on color-separated image data. The image forming units (hereinafter, simply referred to as "units" in some cases) 10Y, 10M, 10C, and 10K are arranged with a predetermined distance therebetween in the horizontal direction. The units 10Y, 10M, 10C, and 10K may be process cartridges which can be detachably mounted on the image forming apparatus body.

An intermediate transfer belt 20 as an intermediate transfer member is disposed above the units 10Y, 10M, 10C, and 10K to extend via the units. The intermediate transfer belt 20 is wound on a driving roller 22 and a support roller 24 contacting the inner surface of the intermediate transfer belt 20, which are separated from each other on the left and right sides in FIG. 1, and travels from the first unit 10Y to the fourth unit 10K. The support roller 24 is urged in the direction in which it gets away from the driving roller 22 by a spring or the like (not shown) and thus a tension is given to the intermediate transfer belt 20 wound on both rollers. A cleaning device 30 opposed to the driving roller 22 is disposed in the side surface of the intermediate transfer belt 20 facing the image holder.

The developing devices (developing units) 4Y, 4M, 4C, and 4K of the units 10Y, 10M, 10C, and 10K can be supplied with developers respectively including four color toners of yellow, magenta, cyan, and black contained in the developer cartridges 8Y, 8M, 8C, and 8K, respectively.

The first to fourth units 10Y, 10M, 10C, and 10K have the same configuration, and thus only the first unit 10Y that is used for forming a yellow image and is disposed upstream in the traveling direction of the intermediate transfer belt will be representatively described. The same elements as the first unit 10Y are referenced by reference numerals having magenta (M), cyan (C), and black (K) added instead of yellow (Y), and the second to fourth units 10M, 10C, and 10K will not be described.

The first unit 10Y includes a photoreceptor 1Y serving as an image holder. Around the photoreceptor 1Y, a charging device 2Y that charges the surface of the photoreceptor 1Y to a predetermined potential, an exposure device (electrostatic charge image forming unit) 3 that exposes the charged surface with a laser beam 3Y based on a color-separated image signal to form an electrostatic charge image, a developing device (developing unit) 4Y that supplies a charged toner to the electrostatic charge image to develop the electrostatic charge image, a primary transfer roller (primary transfer unit) 5Y that transfers the developed toner image onto the intermediate transfer belt 20, and a photoreceptor cleaning device (cleaning unit) 6Y that removes the toner remaining on the surface of the photoreceptor 1Y after the primary transfer, are arranged in this order.

The primary transfer roller 5Y is disposed inside the intermediate transfer belt 20 and is located at a position opposed to the photoreceptor 1Y. Bias sources (not shown) that apply a primary transfer bias are connected to the primary transfer rollers 5Y, 5M, 5C, and 5K, respectively. The bias sources change the transfer bias applied to the primary transfer rollers under the control of a controller (not shown).

The operation of forming a yellow image in the first unit 10Y will be described below. First, before the operation, the surface of the photoreceptor 1Y is charged to a potential of −600 V to −800 V by the charging device 2Y.

The photoreceptor 1Y is formed by stacking a photoconductive layer on a conductive base (with a volume resistivity of $1\times10^{-6}$ Ωcm or less at 20° C.). This photoconductive layer typically has high resistance (corresponding to the resistance of general resin), but has a nature that, when the laser beam 3Y is applied thereto, the specific resistance of a part of the photoconductive layer irradiated with the laser beam changes. Here, the laser beam 3Y is emitted to the surface of the charged photoreceptor 1Y from the exposure device 3 in accordance with yellow image data sent from the controller (not shown). The laser beam 3Y is applied to the photoconductive layer on the surface of the photoreceptor 1Y, whereby an electrostatic charge image of a yellow print pattern is formed on the surface of the photoreceptor 1Y.

The electrostatic charge image is an image formed on the surface of the photoreceptor 1Y by the charging, and is a so-called negative latent image which is formed by applying the laser beam 3Y to a section of the photoreceptor so as to lower the specific resistance of the applied section, to cause charges to flow on the surface of the photoreceptor 1Y, and to cause charges to stay in the section to which the laser beam 3Y is not applied.

The electrostatic charge image formed on the photoreceptor 1Y is moved by rotation to a predetermined development position with the rotation of the photoreceptor 1Y. The electrostatic charge image on the photoreceptor 1Y is visualized (to form a developed image) at the development position by the developing device 4Y.

The electrostatic charge image developer according to an exemplary embodiment of the invention including at least yellow toner and carrier is contained in the developing device 4Y. The yellow toner is frictionally charged by the agitation in the developing device 4Y to have charges with the same polarity (negative polarity) as the electrified charges on the photoreceptor 1Y and is held on the developer roller (developer holder). By allowing the surface of the photoreceptor 1Y to pass through the developing device 4Y, the yellow toner is electrostatically attached to the latent image section having no charge on the photoreceptor 1Y, whereby the latent image is developed with the yellow toner. The photoreceptor 1Y having a yellow toner image formed thereon is kept being driven at a predetermined speed and the developed toner image on the photoreceptor 1Y is carried to a predetermined primary transfer position.

Once the yellow toner image on the photoreceptor 1Y is carried to the primary transfer position, then a primary transfer bias is applied to the primary transfer roller 5Y and an electrostatic force in the direction from the photoreceptor 1Y to the primary transfer roller 5Y acts on the toner image, whereby the toner image on the photoreceptor 1Y is transferred to the intermediate transfer belt 20. The transfer bias applied at this time has the opposite polarity (+) of the toner polarity (−) and is controlled, for example, to be about +10 μA in the first unit 10Y by the controller (not shown).

On the other hand, the toner remaining on the photoreceptor 1Y is removed therefrom and collected by the cleaning device 6Y.

The primary transfer biases applied to the primary transfer rollers 5M, 5C, and 5K of the second unit 10M and the subsequent units (i.e., third unit 10C and fourth unit 10K) are controlled in the same manner as in the case of the first unit.

In this way, the intermediate transfer belt 20 onto which the yellow toner image is transferred in the first unit 10Y is sequentially carried through the second to fourth units 10M, 10C, and 10K and the toner images of respective colors are repeatedly and multiply transferred thereto.

The intermediate transfer belt 20 onto which four color toner images have been multiply transferred by the first to fourth units reaches a secondary transfer section which includes the intermediate transfer belt 20, the support roller 24 contacting the inner surface of the intermediate transfer belt, and a secondary transfer roller (secondary transfer unit) 26 disposed on the image holding side of the intermediate transfer belt 20. On the other hand, a recording sheet (transfer medium) P is fed to a nip between the secondary transfer roller 26 and the intermediate transfer belt 20, which are pressed against each other, at a predetermined time by a feed mechanism and a secondary transfer bias is applied to the support roller 24. The transfer bias applied at this time has the same polarity (−) as the toner polarity (−) and an electrostatic force in the direction from the intermediate transfer belt 20 to the recording sheet P acts on the toner image, whereby the toner image on the intermediate transfer belt 20 is transferred onto the recording sheet P. The secondary transfer bias is determined depending on the resistance detected by a resistance detector (not shown) that detects the resistance of the secondary transfer section, and is voltage-controlled.

Thereafter, the recording sheet P is fed to a pressed section (i.e., nip) between a pair of fixing rollers in the fixing device (roll-like fixing device) 28, the toner image is heated, and the color-superposed toner image is melted and fixed onto the recording sheet P.

Examples of the transfer medium onto which the toner image is to be transferred include plain paper sheets and OHP sheets used in electrophotographic copiers, printers, and the like.

To further improve the smoothness of an image surface after the fixing, it is preferable that the surface of the transfer medium is smooth or flat as much as possible. For example, a coated sheet obtained by coating the surface of a plain paper sheet with a resin or the like or a art coat paper sheet for printing may be suitably used.

After completion of the fixation of the color image on the recording sheet P, the recording sheet P is fed to a discharge unit. Thus, a series of color image forming operations are ended in this way.

The image forming apparatus has a configuration in which the toner image is transferred to the recording sheet P via the intermediate transfer belt 20. However, the invention is not limited to this configuration, and may have a configuration in which the toner image may be transferred directly to the recording sheet from the photoreceptor.

In an exemplary embodiment, the image forming apparatus may employ a trickle developing method. The trickle developing method is a developing method in which a development is carried out while the developer is gradually supplied to the developing device and the excessive exhausted developer (which contains a lot of degraded carrier) is collected from the developing device.

In the trickle developing method, the replenishment and the recovery of the developer are preferably carried out to keep the amount of developer in the developing device within a certain range. An example of the trickle developing method is disclosed as an image forming apparatus in Japanese Patent Application Publication No. 2-21591.

Process Cartridge and Developer Cartridge

Figure 2:
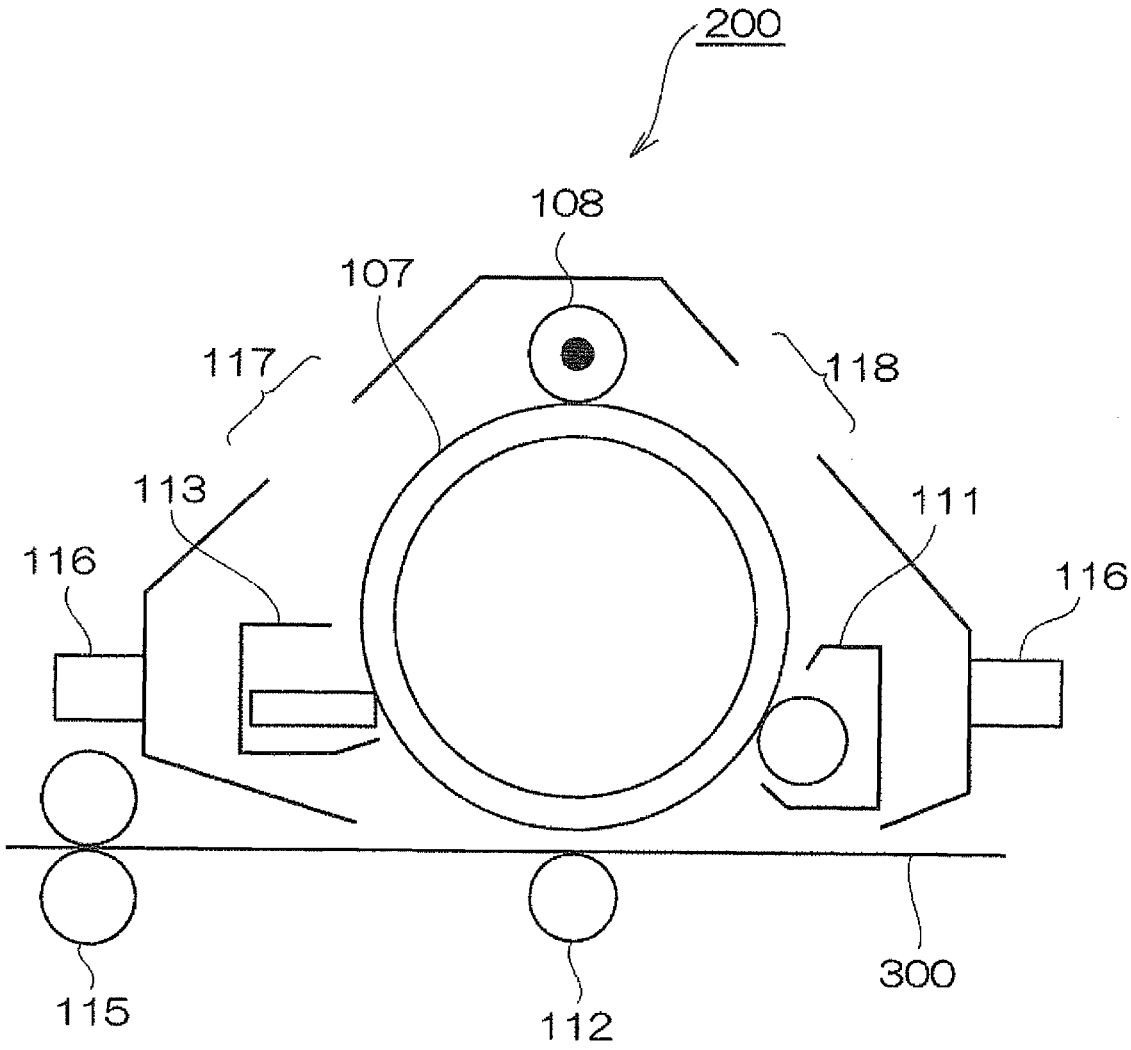
FIG. 2 is a diagram schematically illustrating the configuration of a process cartridge according to an exemplary embodiment of the invention.

FIG. 2 is a diagram schematically illustrating an example of the process cartridge that contains the electrostatic charge image developer according to an exemplary embodiment of the invention. The process cartridge 200 includes: a photoreceptor 107; a charging device 108, a developing device 111; a cleaning device 113, which are integrated using a mounting rail 116, and has an opening for exposure 118 (which may be referred to as "exposure opening"), and an opening for neutralization exposure 117 (which may be referred to as "neutralization exposure opening"). Reference numeral 300 shown in FIG. 2 represents a transfer medium.

The process cartridge 200 is attachable to and detachable from an image forming apparatus (not shown) including a transfer device 112, a fixing device 115, and other elements not shown in FIG. 2.

The process cartridge 200 shown in FIG. 2 includes the charging device 108, the developing device 111, the cleaning device 113, the exposure opening 118, and the electricity-removing exposure opening 117, but these elements may be selectively combined. The process cartridge according to an exemplary embodiment may include the photoreceptor 107 and at least one selected from the group consisting of the charging device 108, the developing device 111, the cleaning device 113, the exposure opening 118, and the neutralization exposure opening 117.

The developer cartridge according to an exemplary embodiment of the invention will be described. The developer cartridge according to the exemplary embodiment is a developer cartridge that is attachable to and detachable from an image forming apparatus and that contains an electrostatic charge image developer for replenishment which is supplied to the developing device in the image forming apparatus.

The image forming apparatus 1 shown in FIG. 1 is an image forming apparatus which has a configuration in which the developer cartridges 8Y, 8M, 8C, and 8K are detachably mounted. The developing devices 4Y, 4M, 4C, and 4K are connected to the developer cartridges corresponding to the developing devices (colors) via toner supply tubes not shown in FIG. 1. When the toner in a developer cartridge runs low, the developer cartridge is replaced with a new developer cartridge.

In the image forming apparatus, the developer cartridge, and the process cartridge according to exemplary embodiments of the invention, the two-component developer according to an exemplary embodiment of the invention is used. Accordingly, even when the amount of toner supplied to the photoreceptor from the developing device (the amount of toner used in development) increases due to the formation of a high-density image and thus the amount of consumed toner increases, or even when the amount of consumed toner decreases due to the formation of a low-density image, it is possible to suppress the variation in charge on the toner included in the two-component developer and to suppress the variation in density of an image to be formed (departure from a target image density of a formed image).

EXAMPLES

The exemplary embodiments of the invention will be described in more detail with reference to examples and comparative examples, but the exemplary embodiments are not limited to the examples. In the absence of any particular description, "parts" and "%" are based on weight in the following description.

Production of Toner

Production of Toner A

Production of Resin Particle Dispersion Solution

| | |
|---|---|
| Styrene: | 308 parts by weight |
| n-Butyl acrylate: | 100 parts by weight |
| Acrylic acid: | 4 parts by weight |
| Dodecane diol: | 6 parts by weight |
| Propanediol acrylate: | 1.5 parts by weight |

These components are mixed and dissolved to obtain a mixture solution. Separately, a solution obtained by dissolving 4 parts by weight of an anionic surfactant DOWFAX (trade name, manufactured by Dow Chemical CO.) in 550 parts by weight of ion-exchange water is put in a flask. Then, the mixture solution is added to the flask, dispersed, and emulsified, and 50 parts by weight of an ion-exchange solution in which 6 parts by weight of ammonium persulfate is dissolved is introduced thereto while slowly stirring and mixing the solution for 10 minutes.

Subsequently, the atmosphere in the system is sufficiently replaced with nitrogen and then the flask is heated using an oil bath while stirring, whereby an emulsification-polymerization is carried out.

As a result, a resin particle dispersion solution containing resin particles having a mean particle diameter (volume-average particle diameter) of 178 nm and having a glass-transition temperature of 52° C. and a weight-average molecular weight Mw of 32,000 is obtained.

Production of Colorant Particle Dispersion Solution

| | |
|---|---|
| Cyan pigment (copper phthalocyanine): | 35 parts by weight |
| Anionic surfactant (NEOGEN SC, trade name, manufactured by Dai-Ichi Kogyo Seiyaku Co., Ltd.): | 6 parts by weight |
| Ion-exchange water: | 200 parts by weight |

These components are mixed and dissolved, and are dispersed using a homogenizer (ULTRA TURRAX, trade name, manufactured by IKA Corporation) by applying ultrasonic waves thereto, thereby obtaining a colorant particle dispersion solution containing colorant particles having a mean particle diameter (volume-average particle diameter) of 167 nm.

Production of Release Agent Particle Dispersion Solution

| | |
|---|---|
| Polyethylene wax (hydrocarbon wax with a melting point of 88° C.): | 50 parts by weight |
| Anionic surfactant (NEOGEN SC, trade name, manufactured by Dai-Ichi Kogyo Seiyaku Co., Ltd.): | 2.3 parts by weight |
| Ion-exchange water: | 200 parts by weight |

This composition is heated at 95° C., is sufficiently subjected to dispersion treatment using ULTRA TURRAX T50 (trade name, manufactured by IKA Corporation), and is then subjected to dispersion treatment using a pressure-ejecting homogenizer, thereby obtaining a release agent particle dispersion solution containing release agent particles having a mean particle diameter (volume-average particle diameter) of 270 nm.

Production of Toner Particle

| | |
|---|---|
| Resin particle dispersion solution: | 187 parts by weight |
| Colorant particle dispersion solution: | 42.7 parts by weight |
| Release agent particle dispersion solution: | 60.0 parts by weight |
| Polyaluminum chloride (10% aqueous solution): | 2.6 parts by weight |
| Ion-exchange water: | 375 parts |

These components are introduced into a cylindrical stainless flask and are sufficiently mixed and dispersed using ULTRA TURRAX T50 (trade name, manufactured by IKA Corporation), and the flask is heated up to 52° C. using a heating oil bath while stirring. Then, the flask is maintained at 52° C., and then 92 parts by weight of the resin particle dispersion solution is additionally added thereto gradually.

Thereafter, the pH in the system is adjusted to 6.5 using an aqueous sodium hydroxide solution having a concentration of 0.5 mol/L. Then, the stainless flask is sealed closely, and is heated up to 97° C. while stirring with the stirring shaft magnetically sealed. After completion of the reaction, the resultant product is cooled, is filtrated, and is sufficiently cleaned with ion-exchange water, and is subjected to solid-liquid separation by Nutsche suction filtration. The resultant is re-dispersed using 3 L of ion-exchange water at 40° C. and is stirred and cleaned at 300 rpm for 15 minutes. This cleaning operation is repeatedly performed five times, and solid-liquid separation is performed using filter paper of No. 5A by Nutsche suction filtration. The resultant product is dried under vacuum for 12 hours, thereby obtaining toner A.

The volume-average particle diameter of toner A is 6.5 μm. The number-size distribution index GSDp is 1.24. The shape of toner A is observed using an image analyzer LUZEX (trade name, manufactured by LUZEX CO.), and it was found that the shape factor SF1 of particles of toner A is 109.

Production of Carrier

Production of Carrier A

First, the following materials are prepared.

| | |
|---|---|
| Ferrite particles (EF35B having a particle diameter of 35 μm, trade name, manufactured by Powder Tech Inc.): | 100 parts |
| Toluene: | 14 parts |
| Perfluorohexylethyl methacrylate/methyl methacrylate copolymer (having a co-polymerization ratio of 40:60 and a molecular weight Mw of 50,000): | 2.4 parts |
| Conductive powder ($BaSO_4$ having an average particle diameter of 0.2 μm and a volume resistivity of 5 to 30 Ωcm, PASTRAN type IV, trade name, manufactured by Mitsui Kinzoku Co., Ltd.): | 0.4 parts |

The materials other than the ferrite particles among of the materials described above are dispersed using a stirrer for 10 minutes to produce a coating solution for forming a coating (which may be referred to as "coating solution"). The coating solution and the ferrite particles are introduced into a vacuum-degassing kneader, and are stirred at 60° C. for 30 minutes. Then, the kneader is depressurized to distill toluene, so that the surfaces of the ferrite particles are coated with a coating, thereby obtaining carrier A. The surface energy of carrier A is 29 dyne/cm. The volume-average particle diameter is 37 μm.

Production of Carrier B

Carrier B is obtained under the same conditions and the same method as in the production of carrier A, except that perfluorohexylethyl methacrylate/methyl methacrylate copolymer used to produce carrier A is replaced with perfluorohexylethyl methacrylate/methyl methacrylate copolymer (having a co-polymerization ratio of 80:20 and Mw of 50,000). The surface energy of carrier B is 25 dyne/cm. The volume-average particle diameter thereof is 37 μm.

Production of Carrier C

Carrier C is obtained under the same conditions and the same method as in the production of carrier A, except that perfluorohexylethyl methacrylate/methyl methacrylate copolymer used to produce carrier A is replaced with polycarbonate (PCZ300, trade name, manufactured by Mitsubishi Gas Chemical Company Inc.). The surface energy of carrier C is 35 dyne/cm. The volume-average particle diameter thereof is 37 μm.

Production of Carrier D

Carrier D is produced with the following composition by using vinylidene polyfluoride instead of perfluorohexylethyl methacrylate/methyl methacrylate copolymer used to produce carrier A.

| | |
|---|---|
| Ferrite particles (EF35B having a particle diameter of 35 μm, trade name, manufactured by Powder Tech Inc.): | 100 parts |
| Polyvinylidene chloride (KYNAR 721, trade name, manufactured by Arkema Inc.): | 2.4 parts |
| Conductive powder ($BaSO_4$ having an average particle diameter of 0.2 μm and a volume resistivity of 5 to 30 Ωcm, PASTRAN type IV, trade name, manufactured by Mitsui Kinzoku Co., Ltd.): | 0.4 parts |

The materials described above are introduced into a vacuum-degassing kneader, and stirred at a room temperature for 30 minutes. Thereafter, the mixture is heated up to 180° C. at a temperature increasing speed of PC/min, and is stirred at 20 rpm at 180° C. for 60 minutes so that the surfaces of the ferrite particles are coated with a coating, thereby obtaining carrier D. The surface energy of carrier D is 21 dyne/cm. The volume-average particle diameter thereof is 37 μm.

Production of Carrier E

Carrier E is obtained under the same conditions and the same method as in the production of carrier A, except that perfluorohexylethyl methacrylate/methyl methacrylate copolymer used to produce carrier A is replaced with 2.4 parts of dimethylaminoethyl methacrylate/methyl methacrylate copolymer (having a co-polymerization ratio of 4:96 and Mw of 55,000). The surface energy of carrier E is 40 dyne/cm. The volume-average particle diameter thereof is 37 μm.

Production of Large-Diameter External Additive

Production of Large-Diameter External Additive A

A stirrer, a dropping funnel, and a thermometer are set up in a glass reactor. Then, 10 parts by weight of ethanol and 30 parts by weight of tetraethoxy silane are introduced thereto, and the mixture is stirred at 100 rpm at 30° C. Then, 40 parts by weight of a 20% ammonia aqueous solution is dripped for 5 minutes while stirring. This reaction is maintained for 1 hour to form silica sol. This silica sol suspension is separated by centrifugation, and the supernatant is removed. Subsequently, 100 parts by weight of toluene is added thereto to form silica sol. Then, 5% by weight of HMDS (hexamethyl disilazane) with respect to the solids in the silica sol is added to the silica sol and the mixture is allowed to react at 100° C. for 3 hours. Thereafter, this suspension is heated to remove toluene, dried, and pulverized, whereby large-diameter external additive A which is an aggregation of mono-dispersed silica, which has a true specific gravity of 1.50, a shape factor SF1 of 140, and a number-average particle diameter of 220 nm is obtained.

Production of Large-Diameter External Additive B

Large-diameter external additive B which is an aggregation of mono-dispersed silica is obtained under the same conditions and by the same method as in the production of large-diameter external additive A, except that the surface treatment is performed using an aminosilane coupling agent (3-aminopropyl trimethoxy silane, KEM-903, trade name, manufactured by Shin-Etsu Silicones Co.), which is added in an amount of 2% by weight with respect to the solids in the suspension, instead of HMDS (hexamethyl disilazane) used to produce large-diameter external additive A. The shape factor SF1 of large-diameter external additive B is 140 and the number-average particle diameter thereof is 232 nm.

Production of Large-Diameter External Additive C

Large-diameter external additive C which is an HMDS surface treated external additive is obtained under the same conditions and by the method as in the production of large-diameter external additive A, except that the content of ethanol is changed to 15 parts by weight. Large-diameter external additive C which has been subjected to an HMDS surface treatment is an aggregation of mono-dispersed silica, which has a shape factor SF1 of 132 and a number-average particle diameter of 226 nm.

Production of Large-Diameter External Additive D

Large-diameter external additive D which is an HMDS surface treated external additive is obtained under the same conditions and by the same method as in the production of large-diameter external additive A, except that the content of ethanol is changed to 7 parts by weight. Large-diameter external additive D which has been subjected to an HMDS surface treatment is an aggregation of mono-dispersed silica, which has a shape factor SF1 of 147 and a number-average particle diameter of 232 nm.

Production of Large-Diameter External Additive E

Large-diameter external additive E which is an HMDS surface treated external additive is obtained under the same conditions and the same method as in the production of large-diameter external additive A, except that the content of ethanol is changed to 10 parts by weight, the reaction temperature is set to 25° C., and the reaction time is shortened to 40 minutes. Large-diameter external additive E which has been subjected to an HMDS surface treatment is an aggregation of mono-dispersed silica, which has a shape factor SF1 of 140 and a number-average particle diameter of 80 nm is obtained.

Production of Large-Diameter External Additive F

Large-diameter external additive F which is an HMDS surface treated external additive is obtained under the same conditions and the same method as in the production of large-diameter external additive A, except that the content of ethanol is changed to 10 parts by weight, the reaction temperature is set to 35° C., and the reaction time is extended to 2.5 hours. Large-diameter external additive F which has been subjected to an HMDS surface treatment is an aggregation of mono-dispersed silica, which has a shape factor SF1 of 140 and a number-average particle diameter of 1,000 nm.

Production of Large-Diameter External Additive G

Large-diameter external additive G which has not been subjected to the surface treatment with HMDS (hexamethyl disilazane) used to produce large-diameter external additive A is obtained. The shape factor SF1 of large-diameter external additive G is 140 and the number-average particle diameter thereof is 220 nm.

Production of Large-Diameter External Additive H

Large-diameter external additive H which is an HMDS surface treated external additive is obtained under the same conditions and the same method as in the production of large-diameter external additive A, except that the content of ethanol is changed to 20 parts by weight. Large-diameter external additive H which has been subjected to an HMDS surface treatment is an aggregation of mono-dispersed silica, which has a shape factor SF1 of 120 and a number-average particle diameter of 185 nm.

Production of Large-Diameter External Additive I

Large-diameter external additive I which is an HMDS surface treated external additive is obtained under the same conditions and the same method as in the production of large-diameter external additive A, except that the content of ethanol is changed to 5 parts by weight. Large-diameter external additive I which has been subjected to an HMDS surface treatment is an aggregation of mono-dispersed silica, which has a shape factor SF1 of 140 and a number-average particle diameter of 220 nm.

Production of Large-Diameter External Additive J

Large-diameter external additive J which is an HMDS surface treated external additive is obtained under the same conditions and the same method as in the production of large-diameter external additive A, except that the content of ethanol is changed to 10 parts by weight, the reaction temperature is set to 25° C., and the reaction time is extended to 30 minutes. Large-diameter external additive J which has been subjected to an HMDS surface treatment is an aggregation of mono-dispersed silica, which has a shape factor SF1 of 140 and a number-average particle diameter of 70 nm.

Production of Large-Diameter External Additive K

Large-diameter external additive K which is an HMDS surface treated external additive is obtained under the same conditions and the same method as in the production of large-diameter external additive A, except that the content of ethanol is changed to 10 parts by weight, the reaction temperature is set to 38° C., and the reaction time is extended to 3.5 hours. Large-diameter external additive K which has been subjected to an HMDS surface treatment is an aggregation of mono-dispersed silica, which has a shape factor SF1 of 140 and a number-average particle diameter of 1,200 nm.

Examples 1 to 9 and Comparative Examples 1 to 6

100 parts by weight of toner A and any of the large-diameter external additives (of which species are as shown in Table 1) in amounts calculated by the following Expression 2 so that the coverage of toner A becomes 20% are stirred at a rotation speed of 16 m/s in the atmosphere of 20° C. using a Henschel mixer for 5 minutes.

$$Cov.(\%) = \frac{\sqrt{3}}{2\pi} \cdot \frac{Dt \cdot \rho t}{Da \cdot \rho a} \cdot \frac{\text{Amount of external additive}}{\text{Amount of toner}} \times 100 \quad \text{Expression 2}$$

"Cov." shown in Expression 2 represents the calculated amount of large-diameter external additive added so as to achieve a coverage of 20%. In Expression 2, "Dt" represents the particle diameter of the toner and "ρt" represents the specific gravity of the toner. In expression 2, "Da" represents the particle diameter of an external additive and "ρa" represents the specific gravity of an external additive.

Thereafter, warm water of 40° C. is circulated in a Henschel mixer jacket, and when the temperature of the toner reaches 50° C., the resultant product is stirred at a rotation speed of 16 m/s for 5 minutes. The resultant product is additionally stirred at a rotation speed of 32 m/s in the atmosphere of 20° C. for 10 minutes and is sieved using a sieve having an aperture diameter of 32 μm, whereby a toner having the large-diameter external additive externally added thereto is obtained.

The toner with the large-diameter external additive externally added thereto and the carrier are weighed at a ratio (toner:carrier) of 8:92 by weight and are stirred with a V blender for 20 minutes, whereby a two-component developer is obtained.

TABLE 1

| | Large-diameter external additive | | | | Carrier | | B/A (A: existence ratio of large-diameter external additive on toner surface B: existence ratio of large-diameter external additive on carrier surface) | | | | |
|---|---|---|---|---|---|---|---|---|---|---|---|
| | | Shape factor SF1 | Number-average particle diameter | Surface treatment agent | | Surface energy [dyne/cm] | Initial state | 1st cycle | 2nd cycle | 3rd cycle | 4th cycle |
| Ex. 1 | large-diameter external additive A | 140 | 220 nm | containing N atom | carrier A | 29 | 0.19 | 0.20 | 0.23 | 0.17 | 0.25 |
| Ex. 2 | large-diameter external additive B | 140 | 232 nm | containing N atom | carrier A | 29 | 0.21 | 0.22 | 0.25 | 0.18 | 0.24 |
| Ex. 3 | large-diameter external additive C | 132 | 226 nm | containing N atom | carrier A | 29 | 0.32 | 0.31 | 0.38 | 0.20 | 0.37 |
| Ex. 4 | large-diameter external additive D | 147 | 232 nm | containing N atom | carrier A | 29 | 0.06 | 0.07 | 0.14 | 0.05 | 0.15 |
| Ex. 5 | large-diameter external additive E | 140 | 80 nm | containing N atom | carrier A | 29 | 0.08 | 0.07 | 0.20 | 0.06 | 0.19 |
| Ex. 6 | large-diameter external additive F | 140 | 1 μm | containing N atom | carrier A | 29 | 0.35 | 0.34 | 0.38 | 0.25 | 0.39 |
| Ex. 7 | large-diameter external additive G | 140 | 220 nm | containing N atom | carrier A | 29 | 0.33 | 0.32 | 0.38 | 0.24 | 0.37 |
| Ex. 8 | large-diameter external additive A | 140 | 220 nm | containing N atom | carrier B | 25 | 0.15 | 0.15 | 0.18 | 0.13 | 0.21 |
| Ex. 9 | large-diameter external additive A | 140 | 220 nm | containing N atom | carrier C | 35 | 0.34 | 0.34 | 0.36 | 0.22 | 0.35 |
| Com. Ex. 1 | large-diameter external additive H | 120 | 185 nm | containing N atom | carrier A | 29 | 0.93 | 0.92 | 1.01 | 0.75 | 1.08 |
| Com. Ex. 2 | large-diameter external additive I | 160 | 220 nm | containing N atom | carrier A | 29 | 0.01 | 0.01 | 0.02 | 0.01 | 0.02 |
| Com. Ex. 3 | large-diameter external additive J | 140 | 70 nm | containing N atom | carrier A | 29 | 0.02 | 0.02 | 0.03 | 0.01 | 0.03 |
| Com. Ex. 4 | large-diameter external additive K | 140 | 1.2 μm | containing N atom | carrier A | 29 | 0.72 | 0.74 | 0.82 | 0.62 | 0.83 |
| Com. Ex. 5 | large-diameter external additive A | 140 | 220 nm | containing N atom | carrier D | 22 | 0.01 | 0.01 | 0.03 | 0.01 | 0.03 |
| Com. Ex. 6 | large-diameter external additive A | 140 | 220 nm | containing N atom | carrier E | 40 | 0.60 | 0.63 | 0.68 | 0.51 | 0.72 |

Measurement of Existence Ratio of External Additive

In the respective two-component developers produced according to the examples and the comparative examples, the ratio (B/A) of existence ratio A of the large-diameter external additive on the toner surface and existence ratio B of the large-diameter external additive on the carrier surface in the machine shipping state (after the shipment inspection) (hereinafter, referred to as "initial state") is calculated. The results are shown in Table 1.

In addition, a reconstructed apparatus is prepared which is obtained by reconstructing APEOS PORT III (trade name, manufactured by Fuji Xerox Co., Ltd.) so as to print out a target image on an arbitrary number of sheets and at an arbitrary processing speed, in which color application paper sheets "J" of A4-size (manufactured by Fuji Xerox Co., Ltd.) are put in a paper container, the two-component developers produced according to the examples are introduced into a developing device and a replenishing cartridge, respectively. This reconstructed apparatus is placed in an environmental chamber controlled to a temperature of 25° C. and a humidity of 50% RH and is made to print out an image under the conditions of 600×600 dpi and a processing speed of 35 sheets/min in A4.

A gray-scale chart of 10% to 100% having halftone images based on halftone dots and a density gradient with a 10% interval is used as the following "gray-scale chart". The gray-scale chart having an image density of 7% as a whole is used. Places having a 100% image density are measured.

Measurement of First Cycle

First, the gray-scale chart is continuously printed out on 500 sheets. At this time, in the two-component developer in the developing device, the ratio (B/A) of the existence ratio A of the large-diameter external additive on the toner surface and the existence ratio B of the large-diameter external additive on the carrier surface is calculated. The result is shown in Table 1.

Measurement of Second Cycle

A high-density image with an image density of 60% is continuously printed out on 1,000 sheets, and then the gray-scale chart is printed out on one sheet. At this time, in the two-component developer in the developing device, the ratio (B/A) of the existence ratio A of the large-diameter external additive on the toner surface and the existence ratio B of the large-diameter external additive on the carrier surface is calculated. The result is shown in Table 1.

Measurement of Third Cycle

After the measurement of the second cycle, a low-density image with an image density of 1% is continuously printed out additionally on 1,000 sheets, and then the gray-scale chart is printed out on one sheet. At this time, in the two-component developer in the developing device, the ratio (B/A) of the existence ratio A of the large-diameter external additive on the toner surface and the existence ratio B of the large-diameter external additive on the carrier surface is calculated. The result is shown in Table 1.

Measurement of Fourth Cycle

After the measurement of the third cycle, a high-density image with an image density of 60% is continuously printed out again on 1,000 sheets, and then the gray-scale chart is printed out on one sheet. At this time, in the two-component developer in the developing device, the ratio (B/A) of the existence ratio A of the large-diameter external additive on the toner surface and the existence ratio B of the large-diameter external additive on the carrier surface is calculated. The result is shown in Table 1.

Evaluation

In the "measurement of the existence ratio of an external additive", the high-density image areas in the gray-scale chart printed out at the time of the measurement of the second cycle, in the gray-scale chart printed out at the time of measurement of the third cycle, and in the gray-scale chart printed out at the time of the measurement of the fourth cycle are measured for concentrations thereof using a concentration measuring apparatus (XRITE 530, trade name, manufactured by X-Rite Inc.). The average of values measured at five points in the high-density image areas in the gray-scale charts, respectively, are used as the concentrations for respective cycles. The evaluation criteria are as follows. In the evaluation criteria, G1 and G2 are acceptable, and G3 and G4 are not acceptable.

G1: The difference between the maximum value and the minimum value of the measured concentrations in the gray-scale charts printed out in the first cycle, the second cycle, and the third cycle is 0.1 or less.

G2: The difference between the maximum value and the minimum value of the measured concentrations in the gray-scale charts printed out in the first cycle, the second cycle, and the third cycle is in the range of from 0.11 to 0.2.

G3: The difference between the maximum value and the minimum value of the measured concentrations in the gray-scale charts printed out in the first cycle, the second cycle, and the third cycle is in the range of from 0.21 to 0.3.

G4: The difference between the maximum value and the minimum value of the measured concentrations in the gray-scale charts printed out in the first cycle, the second cycle, and the third cycle is 0.31 or more.

The concentration measurement results and the evaluation results are shown in Table 2.

TABLE 2

| | Evaluation | | | | | | |
|---|---|---|---|---|---|---|---|
| | Measured concentration | | | | Maximum value – minimum value | Evaluation of concentration variation OK: G1, G2 NG: G3, G4 | Reason for concentration variation in Comparative Examples |
| | 1st cycle | 2nd cycle | 3rd cycle | 4th cycle | | | |
| Ex. 1 | 1.43 | 1.46 | 1.37 | 1.48 | 0.09 | G1 | — |
| Ex. 2 | 1.42 | 1.51 | 1.41 | 1.5 | 0.10 | G1 | — |
| Ex. 3 | 1.4 | 1.56 | 1.38 | 1.54 | 0.18 | G2 | — |
| Ex. 4 | 1.41 | 1.48 | 1.31 | 1.44 | 0.17 | G2 | — |
| Ex. 5 | 1.39 | 1.46 | 1.3 | 1.47 | 0.17 | G2 | — |
| Ex. 6 | 1.43 | 1.59 | 1.4 | 1.58 | 0.19 | G2 | — |
| Ex. 7 | 1.42 | 1.55 | 1.36 | 1.54 | 0.18 | G2 | — |
| Ex. 8 | 1.52 | 1.61 | 1.47 | 1.63 | 0.16 | G2 | — |
| Ex. 9 | 1.39 | 1.56 | 1.39 | 1.55 | 0.17 | G2 | — |
| Com. Ex. 1 | 1.43 | 1.63 | 1.24 | 1.62 | 0.39 | G4 | Migration of external additive |
| Com. Ex. 2 | 1.44 | 1.45 | 1.15 | 1.48 | 0.33 | G4 | Low transfer efficiency at low image density |
| Com. Ex. 3 | 1.41 | 1.46 | 1.16 | 1.45 | 0.30 | G4 | Low transfer efficiency at low image density |
| Com. Ex. 4 | 1.41 | 1.63 | 1.17 | 1.64 | 0.37 | G4 | Migration of external additive |
| Com. Ex. 5 | 1.55 | 1.66 | 1.42 | 1.67 | 0.25 | G3 | Excessive development due to low charging CA |
| Com. Ex. 6 | 1.39 | 1.54 | 1.25 | 1.56 | 0.31 | G4 | Migration of external additive |

It can be seen from the results that the variation in concentration of an image in Examples of the invention is suppressed as compared to Comparative Examples, even when the amount of consumed toner changes. This is because the variation in charge on the toner of Examples included in the developer is suppressed even when the amount of consumed toner changes.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A two-component developer comprising:

a toner;

a carrier having a surface energy of from about 23 dyne/cm to about 37 dyne/cm; and an external additive having a shape factor SF1 of from about 130 to about 150 and a number-average particle diameter of from about 80 nm to about 1 μm;

wherein:

an existence ratio A of the external additive on a surface of the toner and an existence ratio B of the external additive on a surface of the carrier satisfying the relationship of the following Expression 1:

$$0.04 \leq B/A \leq 0.4; \quad \text{Expression 1:}$$

the carrier comprises a core and a coating layer thereon; and the coating layer comprises a resin selected from the group consisting of a perfluorohexylethyl methacrylate/methyl methacrylate copolymer, a perfluorobutylethyl methacrylate/methyl methacrylate copolymer, isobornyl methacrylate, adamantane methacrylate, and alkoxysilyl methacrylate.

2. The two-component developer according to claim 1, wherein the external additive comprises a hydrophobized surface layer.

3. The two-component developer according to claim 1, wherein the toner further comprises a binder resin, a colorant, and a release agent.

4. The two-component developer according to claim 3, wherein the binder resin comprises a styrene-acrylic resin having a weight-average molecular weight Mw of from about 20,000 to about 100,000.

5. The two-component developer according to claim 3, wherein the binder resin comprises a polyester resin having a weight-average molecular weight Mw of from about 5,000 to about 40,000.

6. The two-component developer according to claim 3, wherein the binder resin has a glass transition temperature of from about 40° C. to about 80° C.

7. The two-component developer according to claim 3, wherein the release agent has a melting point of from about 50° C. to about 110° C.

8. The two-component developer according to claim 3, wherein the content of the release agent in the toner is from about 1% by weight to about 15% by weight with respect to the toner.

9. The two-component developer according to claim 1, wherein the toner has a volume-average particle diameter of from about 2 μm to about 10 μm.

10. The two-component developer according to claim 1, wherein the toner has a shape factor SF1 of from about 120 to about 140.

11. The two-component developer according to claim 1, wherein the carrier has a volume resistivity of from about 1×105Ω·cm to about 1×1015Ω·cm.

12. A developer cartridge accommodating the two-component developer according to claim 1.

13. A process cartridge comprising:

the two-component developer according to claim 1; and a developer holder which holds and transfers the two-component developer.

14. An image forming apparatus comprising:

an image holder;

a charging device that charges a surface of the image holder;

a latent image forming device that forms an electrostatic latent image on the charged surface of the image holder;

a developing device that holds the two-component developer according to claim 1 and develops the electrostatic latent image using the toner included in the two-component developer to form a toner image; and a transfer device that transfers the toner image formed on the surface of the image holder to a transfer medium.

* * * * *